US005934576A

United States Patent [19]

Robinette

[11] Patent Number: 5,934,576

[45] Date of Patent: Aug. 10, 1999

[54] TRASH DISPOSAL SYSTEM

[76] Inventor: Troy A. Robinette, 3110 S. County Road 225 E., Danville, Ind. 46122

[21] Appl. No.: 09/061,407

[22] Filed: Apr. 16, 1998

Related U.S. Application Data

[60] Provisional application No. 60/044,680, Apr. 18, 1997.

[51] Int. Cl.[6] ..... B02C 18/40

[52] U.S. Cl. ..... 241/15; 241/21; 241/29; 241/38; 241/46.01; 241/DIG. 38

[58] Field of Search ..... 241/38, 46.013, 241/DIG. 38, 15, 21, 29, 46.01, 152.2

[56] References Cited

U.S. PATENT DOCUMENTS

| | | | |
|---|---|---|---|
| 3,904,131 | 9/1975 | Farrell, Jr. et al. | 241/46.02 |
| 4,081,146 | 3/1978 | Yagi | 241/152.2 |
| 4,423,987 | 1/1984 | Powers | 241/DIG. 38 X |
| 5,534,147 | 7/1996 | Kallenbach et al. | 210/605 |
| 5,773,281 | 6/1998 | Ichikawa et al. | 241/DIG. 38 X |

*Primary Examiner*—John M. Husar
*Attorney, Agent, or Firm*—Baker & Daniels

[57] ABSTRACT

A trash disposal system for a building which facilitates the process of disposing of trash created within that building. The system includes a chute having an inlet within the building which routes the trash to one or more comminutors, such as grinders, arranged in series. The particles output from the comminutors are reduced in size and pass into a collection vessel installed underground external to the building. An agitator within the collection vessel mixes the trash particles introduced therein and promotes dissolution of the trash particles into water within the collection vessel. The water within the collection vessel, and the trash particles dissolved in that water, are either pumped or flow by gravity from the collection vessel to either a sewer lateral or a drain field for distribution. A method of disposing of trash is also disclosed.

20 Claims, 2 Drawing Sheets

TRASH DISPOSAL SYSTEM

CROSS-REFERENCE TO RELATED APPLICATION

This application claims the benefit under 35 U.S.C. § 119(e) of U.S. provisional application Ser. No. 60/044,680, filed Apr. 18, 1997.

BACKGROUND OF THE INVENTION

The present invention pertains to a system utilized in the disposal of trash created within a house or other building.

Both at home and at work, people are continuously generating trash or refuse that requires disposal. One standard manner of disposing of trash, especially trash generated at home, is to bag it and deliver it curbside for pick-up. After being picked up from curbside, the trash may be transported to an incinerator and burned, or transported to a landfill and buried.

One problem with curbside trash pick-up is that frequently the trash must be handled repeatedly. Not only must people carry the trash outside to a garbage pail during the week when an indoor wastebasket is full, but on trash day, sometimes heavily loaded garbage pails must be dragged to curb for pick-up. Then, the garbage pails must be brought in after pick-up of the trash. This task of handling the garbage is burdensome, particularly during inclement weather. Furthermore, some people, such as the elderly and handicapped, may find these garbage handling tasks especially onerous.

Another problem with garbage disposal is that as the population continues to grow, more and more people are creating trash requiring disposal. In order to increase the useful life of landfills so as to postpone the need for additional landfills to serve the trash disposal needs of the growing population, it would be desirable that trash delivered to landfills be reasonably compact and low volume.

Thus, it would be desirable to provide a trash disposal system which overcomes these and other problems inadequately addressed by the prior art.

SUMMARY OF THE INVENTION

The present invention provides a trash disposal system that allows a person to dispose of trash generated in a house or office building in a convenient fashion. The system allows input of trash in the building, and then comminutes the trash and conveys it as small particles into an underground collection tank. Particles which dissolve in water introduced into the tank are pumped or flow by gravity with the water to a wastewater treatment system, or alternatively to a drain field for distribution. The non-dissolvable trash particles which accumulate on a screen in the tank may on occasion be emptied from the tank and transported as a compact waste material to an alternate disposal site.

In one form thereof, the present invention provides a trash disposal system for a building including an inlet accessible within the building and adapted to receive trash, and a comminutor connected to the inlet by a conduit and structured and arranged to reduce the trash introduced through the conduit into comminuted particles of a smaller size. The system also includes a collection vessel installable underground external to the building and into which passes the comminuted particles output from the comminutor, and an agitator within the collection vessel to mix the comminuted particles.

In another form thereof, the present invention provides a trash disposal system for a building including a chute within the building adapted to receive trash including first particles of at least a first size, a first comminutor having an inlet into which the trash received by the chute is introduced, wherein the first comminutor is structured and arranged to reduce the first particles into first level comminuted particles of a second size smaller than the first size, a second comminutor having an inlet into which is introduced the first level comminuted particles, wherein the second comminutor is structured and arranged to reduce the first level comminuted particles into second level comminuted particles of a third size smaller than the second size, and a collection vessel into which passes the second level comminuted particles output from the second comminutor, wherein the collection vessel is installable underground external to the building.

In still another form thereof, the present invention provides a method of disposing of trash produced in a building including the steps of placing trash into a chute that has an inlet within the building and that leads to a comminutor, comminuting the trash within the comminutor into reduced refuse generally having a smaller particle size than the trash, passing the reduced refuse output from the comminutor into a collection vessel installed underground external to the building, filling at least partially the collection vessel with fluid such that reduced refuse accumulated therein is exposed to the fluid, mixing the reduced refuse within the collection vessel with an agitator projecting within the collection vessel to foster the dissolution of the reduced refuse into the fluid, and discharging fluid with dissolved reduced refuse from the collection vessel to one of a drain field and a sewer system.

One advantage of the present invention is that it eliminates the need for people to deliver trash during the week to an outdoor storage location and from that location to curbside on trash day.

Another advantage of the present invention is that input trash is reduced in volume so as to require a minimal amount of room at a landfill when eventually delivered to the landfill.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Although the drawings represent multiple embodiments of the present invention, the drawings are not necessarily to scale and certain features may be exaggerated or omitted in order to better illustrate and explain the present invention.

DESCRIPTION OF THE PREFERRED EMBODIMENTS

Figure 1:
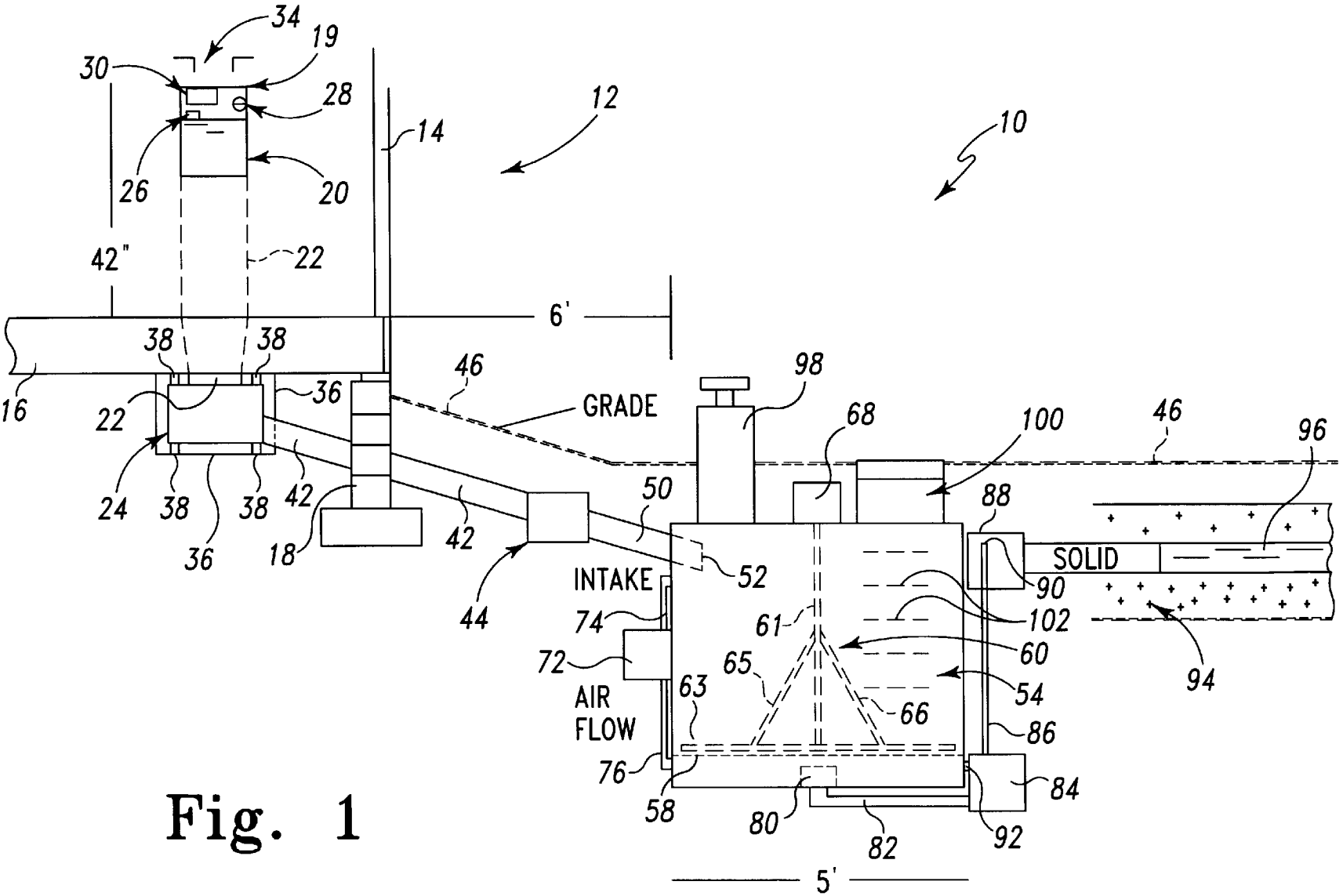
FIG. 1 is a diagrammatic front view of a first embodiment of an installed trash disposal system of the present invention.

Referring now to FIG. 1, there is diagrammatically shown a first embodiment of a trash disposal system of the present invention, generally designated 10. Due to the fact that it reduces refuse volume by the dissolution of trash particles in water and then the discharge of that water, the shown system is also considered a trash dissolvent system. Trash dissolvent system 10 is shown operatively installed in a house generally referenced at 12. Although further described herein with reference to its use in a residential dwelling, trash dissolvent system 10 may find beneficial application in other settings, such as in commercial buildings and the like. House 12 is of conventional design and is shown as including exterior walls 14, a floor 16 over a crawl space (or basement), and a foundation 18.

A first component of the trash dissolvent system 10 is a trash receptacle or dump site accessible within house 12. In this embodiment, the dump site comprises a forward facing control panel 19 and hinged door 20 which pivots downward in a fashion similar to a conventional dishwasher. Hinged door 20 accesses a stainless steel chute 22 that passes through house floor 16 and extends to the inlet of a first grinder 24. Hinged door 20 is positioned off the house floor 16 and equipped with a safety latch 26 to prevent undesired entry by underage users. Hinged door 20 also preferably is connected to a safety switch (not shown) that prevents operation of the comminutors or grinders of the system while door 20 is open. Control panel 19 also includes an emergency stop button 28 and various controls and displays shown generally at 30 which allow a user to control and regulate operation of system 10. A water source abstractly shown at 34 supplies a flow of water into chute 22. This water aids in keeping trash flowing into and through grinder 24 and the other components as described further below. Water source 34 may be furnished as a dedicated supply line or may be selectively connectable with the faucet of the kitchen sink.

To help prevent garbage from becoming stuck in chute 22, a weight that is suspended from the top of the chute above door 20 may be used. The weight may be attached to the door through a pulley system that causes the weight to be lifted clear of the door opening when the door is pivoted open, and which is lowered back down in the chute when the door is subsequently pivoted closed to rest on and force downward garbage temporarily jammed in the chute.

Rather than the front loading trash receptacle shown, a top loading dump site may be used. Hinged door 20 may be provided at any location within house 12, but typically will be located in a kitchen where much of the ordinary household refuse is generated.

Grinder 24 is mounted to the underside of house floor 16 within the crawl space via straps 36. Rubber mounts 38 positioned between grinder 24 and both floor 16 and straps 36 dampen vibrations associated with grinder operation. Grinder 24 serves to reduce or grind trash dumped through door 20 and chute 22 into smaller sized particles. One type of grinder utilizes a grinding wheel which is rotated within the protective grinder housing at a high rate of speed by means of an electric motor and associated pulleys externally mounted on the grinder housing. One suitable grinder wheel includes a carbon or diamond tipped tool that rotates within the protective housing at between about twelve thousand and fifteen thousand revolutions per minute. Other types of grinders, including grinder pumps, may be substituted within the scope of the invention.

Grinder 24 is a coarse grinder which converts large, bulky items of trash input thereto into small particles of trash. A suitable typical size of these particles is a particle diameter of up to about three-quarter inch to one inch. These trash particles are output to a six inch diameter stainless steel pipe 42 that passes through house foundation 18 and feeds a second grinder 44. Pipe 42 is installed with a steady decline or slope such that the trash particles passing therethrough do so under the force of gravity coupled with the flushing effect of water delivered by water source 34.

Second grinder 44 is shown installed under ground 46 outside of house 12. While burying grinder 44 outside of house 12 results in the grinder being hidden from view, depending on conditions such as the height of the house and the positioning of the collection tank, grinder 44 could be positioned above ground 46 or inside house 12. Still further, to facilitate accessibility over the shown arrangement, grinder 44 may alternatively be installed inside the collection tank. Second grinder 44 is a fine grinder that further reduces the small sized trash particles output from grinder 24 into even smaller particles of trash. The particles of trash output from grinder 44 into a three inch diameter stainless steel pipe 50 have the general overall size characteristics of sawdust in that the standard particle size is about one-sixteenth of an inch in diameter. Second grinder 44 may comprise an electrically powered grinding wheel configured similar to first grinder 24, or an alternate type of machine such as a grinding pump. While a single grinder may be employed within the scope of the invention, the dual grinders employed in system 10 are preferred as they allow smaller and affordable, commercially available products to be employed.

Stainless steel pipe 50 is sloped and has an outlet end 52 that ports into a collection tank or vessel 54 buried under ground 46, such as about thirty-two inches below grade for a new home. For existing homes, the depth to which the collection tank is buried may depend on the existing grade and the space in which it is installed. Collection tank 54 is shown cylindrical and has an inner diameter of about five feet and a height of about six feet to provide a holding capacity of about 1,000 gallons. Otherwise shaped and sized vessels may naturally be employed for tank 54 within the scope of the present invention. Tank 54 is constructed of steel reinforced concrete, or other rigid and durable materials such as a high strength plastic. The exterior of tank 54 may be provided with an epoxy coating to resist unintended fluid leakage therefrom.

Mounted proximate to and at a fixed height from the interior bottom of tank 54 is a straining screen 58 on which trash outlet from pipe end 52 lands. Screen 58 is formed by providing vertical drain holes through a circular stainless steel plate. The screen plate has a uniform thickness of about one-eighth (1/8) inch and covers the entire cross-sectional area of tank 54. The vertical drain holes, which are about one thirty-secondth (1/32) of an inch in diameter, are uniformly spaced around the area of the screen plate. One suitable drain hole arrangement is the placement of one drain hole in each two inch square surface area of the plate. Different numbers and sizes of drain holes may be provided, but the diameter of the holes is sized smaller than the average particle size of trash being outlet from grinder 44.

A mixer or agitator, generally designated 60, is mounted within tank 54 and serves to distribute and churn the garbage accumulated on screen 58. Agitator 60 is formed of one inch diameter steel rod pieces rigidly interconnected together, such as by welding, and includes a vertical rod section 61, a horizontal rod section 63, and braces 65 and 66. Rod section 63 extends approximately the entire diameter of tank 54. The upper end of vertical rod section 61 is connected to a gear assembly and electric motor indicated at 68 mounted atop tank 54. Motor 68 operates to rotate agitator 60, which causes horizontal rod section 63 to rotate. Rod section 63 is spaced slightly from screen 58, but wire brushes (not shown) attached along the length of rod section 63 project from the underside of rod section 63 and contact screen 58. As rod section 63 rotates, the wire brushes sweep along the surface of screen 58 to aid in unblocking the drain holes. Along its length, rod section 61 may be configured with an auger which pulls trash upward as rod section 61 rotates to aid in mixing trash in the collection tank. One suitable motor is a two hundred thirty volt, two horsepower electric motor with a capacitor start having an output shaft rotation of 1725 rpms. The gear assembly associated with motor 68 results in agitator 60 rotating at between about twenty-five and fifty rpms. Motor 68, as well as all of the other electrically powered components of system 10, is connected to a not shown power source in house 12 as well as to control panel 19 with electrical circuitry in a conventional manner known in the art and not further shown herein for purposes of illustration.

An electric air pump 72 is exteriorly mounted along the side of tank 54 and connected to air intake pipe 74 and air exhaust pipe 76. A heating element to warm air circulated through pump 72 may be provided in pump 72 or elsewhere along the air flow path. The inlet for intake pipe 74 ports into the interior chamber of tank 54 at a height above screen 58 and just below pipe end 52. The outlet for exhaust pipe 76 ports into the interior chamber of tank 54 at a height below screen 58. During operation of air pump 72, air is blown from exhaust pipe 76, rises or percolates upward through the holes in screen 58 and the garbage collected thereon, and is drawn into intake pipe 74 for continuous recirculation. The inlet and outlet ports for pipes 74 and 76 may be positioned at multiple circumferential locations around tank 54. Air pump 72 preferably operates around the clock to expedite the breakdown of trash within tank 54.

A hole in the base or bottom of tank 54 is covered with a perforated or screen drain cover 80 and connected to a two inch diameter polyvinyl chloride (PVC) drain pipe 82 connected to an electric water pump 84 mounted exteriorly of tank 54. The outlet of pump 84 feeds a one inch diameter PVC pipe 86 that vertically extends into a distribution box 88. Check valve 90 prevents backflow of fluid within box 88 into pipe 86. Laterally extending from box 88 into an underground gravel fill or drain field 94 are one or more four inch diameter pipes with perforated end sections 96. Drain field 94 is preferably separate from any septic field so as to be dedicated to trash disposal. Fluids pumped into box 88 flow out through perforated pipes or fingers 96 to be distributed into drain field 94 in a manner similar to conventional septic systems. The number and shape of perforated fingers 96 depends on the arrangement and the area of the drain field 94. An overflow drain 92 porting through the side of tank 54 is connected to pump 84 to allow fluid drainage should drain cover 80 become blocked.

Rather than the shown pump placement, pump 84 may be installed within the collection tank in the space below screen 58. This internal pump can be connected to a pipe which ports through the side wall of tank 54 and extends to pipe 86. For such a pump placement, drain cover 80 and drain pipe 82 may be eliminated, which facilitates construction. In still another embodiment, the water pump may be installed in distribution box 88.

Distribution box 88, fingers 96 and drain field 94 may be replaced in an alternate and preferred embodiment of the invention with a sewer lateral. In particular, pipe 86 including check valve 90 may be connected to a sewer lateral connected to the wastewater treatment system which otherwise serves house 12. Fluid draining from collection tank 54 is consequently pumped by pump 84 to the sewer lateral and in effect the wastewater treatment system for treatment.

A twelve inch covered air vent is shown at 98 and allows air within tank 54 to be exhausted above ground. In an alternate embodiment not shown, the air vent may be routed underground to the house and then up through the house to an exhaust opening protruding through the roof of the house in a similar fashion to the manner plumbing vents are conventionally configured. A ground level entry hatch or manhole generally indicated at 100 is provided atop the top wall of tank 54. Entry hatch 100 opens into the tank interior and allows tank inspection as well as access to clean out or remove, such as by vacuuming, the accumulated trash. Ladder rungs indicated at 102 are attached to the interior wall of tank 54 to aid a person in entering and leaving tank 54.

The structure of trash dissolvent system 10 will be further understood in view of the following description of its operation. When a person in house 12 wishes to dispose of trash, rather than take the trash outside, the person releases latch 26, opens door 20, and drops or throws the trash into chute 22. The trash falls by gravity through chute 22 into coarse grinder 24. The person then operates controls 30 to cause system 10 to begin operation. The system first activates grinder 24 and water source 34. The water supplied by source 34 wets the grinder 24 to aid its operation and flushes the reduced size trash particles output from grinder 24 through pipe 42 to the fine grinder 44. Grinder 44 in turn reduces the trash into even smaller particles that are flushed by the continuing flow of water through pipe 50 into tank 54 and onto screen 58 (or onto trash previously accumulated on screen 58).

As grinder 44 is operating, agitator 60 is rotated by motor 68 to mix any garbage already on screen 50 as well as distribute the additional garbage being output from grinder 44. The water introduced through pipe 50 wets any garbage already on screen 58. The water passes down through the garbage and through the perforations on screen 58 to pass into the tank chamber below screen 58. As the water so passes through the garbage, pieces of garbage which are dissolvable in water, such as paper products, or which have otherwise deteriorated or broken down over time to a size smaller than the perforations through screen 58 are flushed with the water through screen 58 into the tank chamber beneath screen 58. The fluid and materials within this chamber are drawn by pump 84 through drain cover 80 and pipe 82 and forced through pipe 86 into either the sewer lateral or the box 88 and fingers 96 for distribution to drain field 94 as described above.

It will be recognized that over time, and because the periodic introduction of additional trash into system 10 causes more water to be delivered into tank 54, trash accumulated on screen 58 will be repeatedly wetted, dried, and rewetted by the water emptying into tank 54 through pipe end 52, the spinning of agitator 60, and the use of air pump 72. These wetting/drying cycles speeds the deterioration and dissolution of the trash.

Over time, materials such as plastics and glass that do not degrade or dissolve and which have a particle size greater than the perforations of screen 58 continue to accumulate on screen 58. On occasion, hatch cover 100 may be removed, and the contents of tank 54 on screen 58 may be vacuumed out for transport to a disposal site such as a landfill. It will be appreciated that because the accumulated trash materials have been finely comminuted, the volume occupied by that quantity of trash is reduced. Moreover, because a portion of the trash which is dissolvable has been removed, lesser amounts of trash than were originally thrown away into the system 10 need to be disposed of at a landfill.

The various components of system 10 may be designed to start and stop automatically (subject to an override by emergency stop button 28) and in unison or in stages, or may be started and stopped manually by use of controls 30. For example, a user may wish to stop the system when he/she hears that the trash grinding process has been completed.

The various components of system 10 may be programmed to operate at different times during use of system 10. For example, while water source 34, grinder 44, agitator 60 and pump 84 may be programmed to start operation as soon as grinder 24 begins operation, these system components may be programmed to shut off simultaneously or after a set period of time has elapsed after grinder 24, or another system component, is shut off. Or, different components, such as water source 34 and/or agitator 60 and pump 84 may be programmed to operate periodically while grinders are not being utilized to expedite trash degradation. Still further, sensors may be provided in the grinders or within tank 54 to selectively operate the system components at appropriate times. And, an alarm system, such as an indicator light, can be used which includes a sensor that causes the light to be illuminated when the collection tank needs to be emptied.

Figure 2:
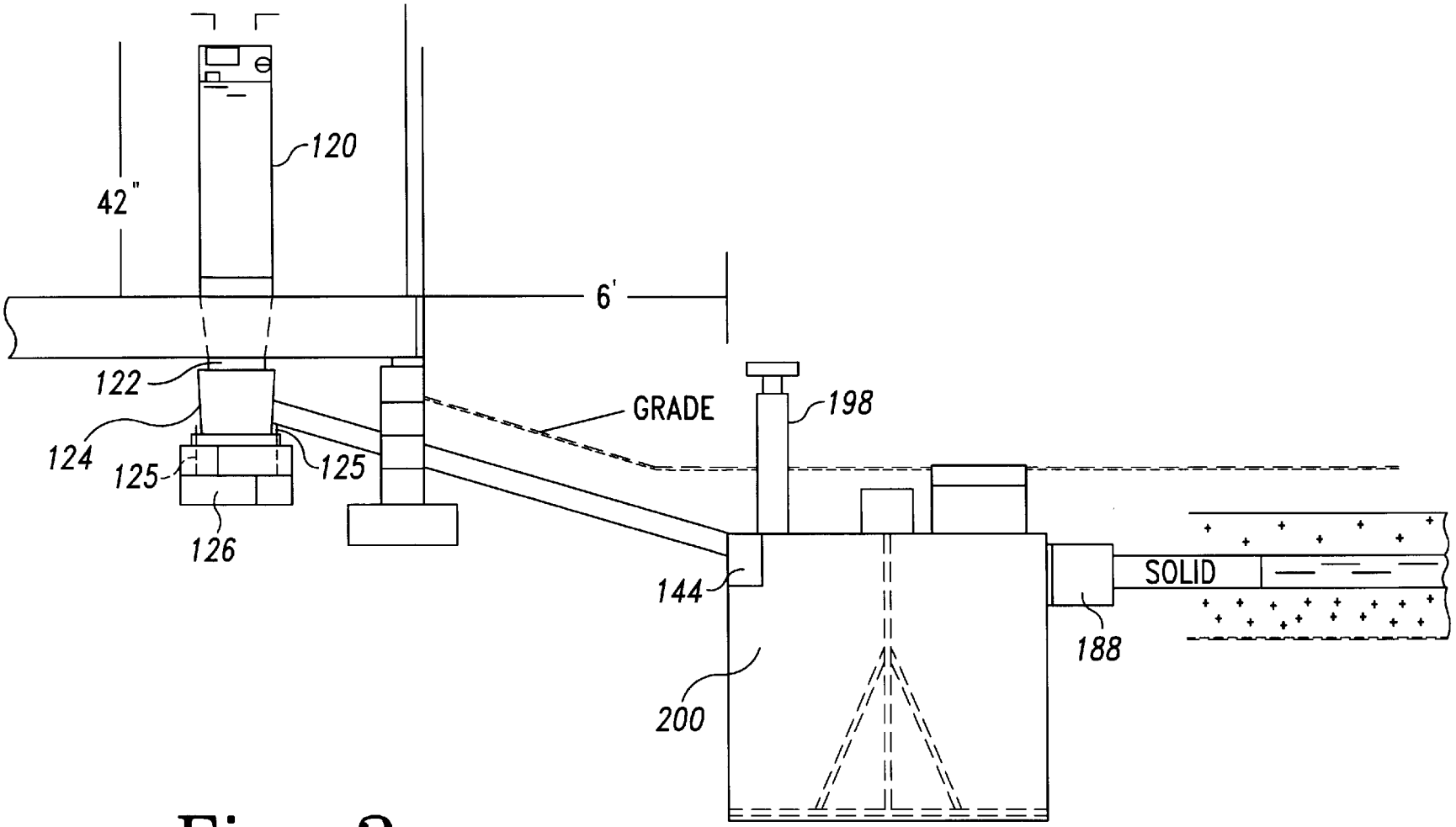
FIG. 2 is a diagrammatic front view of a second embodiment of an installed trash disposal system of the present invention.

Referring now to FIG. 2, there is shown a second embodiment of a trash dissolvent system of the present invention. This system is conceptually similar to the system shown in FIG. 1 in most respects, and therefore only selected differences between the systems are described further herein. The trash dissolvent system of FIG. 2 includes a taller hinged door 120 to simplify trash insertion. First grinder 124 is mounted with bolts 125 to a concrete block 126 installed on the ground within the crawl space of the house. Rubber mounts and straps are used to connect grinder 124 to the bottom end of the trash chute 122 to limit vibrations of the chute. Second grinder 144 is installed within the internal volume of collection tank 200, and the grinder output falls directly into the tank. A six inch air vent 198 vents to atmosphere.

The aeration system used to percolate air through the wet trash, and the pumping system for removing fluid from the tank bottom, that are shown employed in the embodiment of FIG. 1 are not employed in this alternate embodiment. Instead, the system shown in FIG. 2 is an overflow type system. Trash and water accumulate on the bottom of tank 200 rather than on any sort of screen. The agitator does not include the wire brushes along its underside as does the agitator of the embodiment of FIG. 1 because no screen having holes requiring unclogging is present. Water introduced into the tank, possibly with chemicals to expedite the breakdown of the trash, continues to collect therein until it reaches an overflow opening through the tank side wall at the height of collection box 188. The overflowing fluid with dissolved trash outlets under gravity through this opening into box 188, and then out through the pipes to the shown drain field or to a sewer lateral.

While this invention has been shown and described as having multiple designs, the present invention may be further modified within the spirit and scope of this disclosure. For example, while grinders have been described as being used to reduce the size of the trash particles, it will be appreciated that other forms of comminutors, including shredders, that achieve a reduction in size of the trash may be employed. In addition, the air pump may be mounted interiorly within the collection tank 54. This application is therefore intended to cover any variations, uses, or adaptations of the invention using its general principles. Further, this application is intended to cover such departures from the present disclosure as come within known or customary practice in the art to which this invention pertains.

What is claimed is:

1. A trash disposal system for a building comprising:

an inlet accessible within the building and adapted to receive trash including first particles, said first particles being of a first size or larger;

a hinged door pivotable between first and second positions, wherein said hinged door when in said first position covers said inlet to prevent introduction of trash into said inlet, and wherein said hinged door when in said second position uncovers said inlet to permit introduction of trash into said inlet;

a comminutor connected to said inlet by a conduit, said comminutor structured and arranged to reduce said first particles introduced through said conduit into comminuted particles of a second size, said second size being smaller than said first size;

collection vessel into which passes said comminuted particles output from said comminutor, said collection vessel installable underground external to the building; and a mechanical agitator within said collection vessel to mix said comminuted particles.

2. The trash disposal system of claim 1 further comprising a means for introducing water into said comminutor while said comminutor reduces said first particles to said comminuted particles.

3. The trash disposal system of claim 2 further comprising at least one perforated pipe in flow communication with said collection vessel and installable within a drain field external to the building, wherein water that passes into said comminutor and then into said collection vessel with said comminuted particles is dischargeable from said collection vessel through said at least one perforated pipe.

4. The trash disposal system of claim 3 further comprising a pump in flow communication with said collection vessel, and a distribution box connected to said at least one perforated pipe and in flow communication with said pump, wherein said pump is operable to force water within said collection vessel to said distribution box for discharge through said at least one perforated pipe.

5. The trash disposal system of claim 1 further comprising an air vent extending between said collection vessel and a space above ground.

6. The trash disposal system of claim 1 further comprising a screen installed within said collection vessel in spaced apart relationship with a base of said collection vessel and upon which said comminuted particles accumulate, and wherein said agitator mixes said comminuted particles accumulated on said screen.

7. The trash disposal system of claim 6 further comprising an aerator for introducing air into said collection vessel below said screen, whereby air is capable of passing upward through holes in said screen and comminuted particles accumulated on said screen to foster breakdown of said comminuted particles.

8. The trash disposal system of claim 1 further comprising a control panel proximate said door including a control circuited with said comminutor for stopping operation of said comminutor.

9. The trash disposal system of claim 1 wherein said hinged door is generally vertically arranged when disposed in said first position, whereby said inlet serves as a front loading trash inlet.

10. A trash disposal system for a building comprising:

a chute within the building adapted to receive trash including first particles, said first particles being of a first size or larger;

a first comminutor within the building having an inlet for the introduction of trash received by said chute, said first comminutor structured and arranged to reduce said first particles into first level comminuted particles of a second size, said second size being smaller than said first size;

a second comminutor having an inlet for the introduction of said first level comminuted particles, said second comminutor structured and arranged to reduce said first level comminuted particles into second level comminuted particles of a third size, said third size being smaller than said second size;

a trash conveying pipe connecting said first and second comminutors; and a collection vessel into which passes said second level comminuted particles output from said second comminutor, said collection vessel installable underground external to the building, wherein said second comminutor is disposed within said collection vessel.

11. The trash disposal system of claim 10 further comprising an agitator within said collection vessel to mix said second level comminuted particles.

12. The trash disposal system of claim 10 further comprising a water source adapted to provide a flow of water into said first and second comminutors to aid in flushing particles therethrough during operation.

13. The trash disposal system of claim 12 further comprising at least one perforated pipe in flow communication with said collection vessel and installable within a drain field external to the building, wherein water that passes from said water source through said first and second comminutors and then into said collection vessel with said second level comminuted particles is dischargeable from said collection vessel through said at least one perforated pipe.

14. The trash disposal system of claim 10 further comprising an air vent extending between said collection vessel and a space above ground.

15. The trash disposal system of claim 10 wherein said collection vessel comprises a ground level entry hatch through which contents of said collection vessel are removable.

16. The trash disposal system of claim 10 further comprising a screen installed within said collection vessel in spaced apart relationship with a base of said collection vessel and upon which said second level comminuted particles accumulate.

17. The trash disposal system of claim 10 further comprising an aerator for introducing air into said collection vessel below said screen, whereby air is capable of passing upward through holes in said screen and second level comminuted particles accumulated on said screen to foster breakdown of said second level comminuted particles.

18. The trash disposal system of claim 10 wherein a chute inlet within the building is open to permit trash insertion when a pivotable door is disposed in a first arrangement, and closed to prevent trash insertion when said pivotable door is disposed in a second arrangement.

19. A method of disposing of trash produced in a building comprising the steps of:

placing the trash into a chute that has an inlet within the building and which leads to a comminutor;

comminuting the trash within the comminutor into reduced refuse generally having a smaller particle size than the trash;

passing the reduced refuse output from the comminutor into a collection vessel installed underground external to the building;

filling at least partially the collection vessel with fluid such that reduced refuse accumulated therein is exposed to the fluid;

mixing the reduced refuse within the collection vessel with a rotatable, mechanical agitator projecting within the collection vessel to foster the dissolution of the reduced refuse into the fluid; and discharging fluid with dissolved reduced refuse from the collection vessel to one of a drain field and a sewer system.

20. The method of claim 19 wherein the fluid filling step comprises introducing water into the comminutor during comminuting operations to lubricate the comminutor and flush the reduced refuse from the comminutor and into the collection vessel.

* * * * *

UNITED STATES PATENT AND TRADEMARK OFFICE

CERTIFICATE OF CORRECTION

PATENT NO. : 5,934,576

DATED : August 10, 1999

INVENTOR(S) : Troy A. Robinette

It is certified that error appears in the above-identified patent and that said Letters Patent is hereby corrected as shown below:

In claim 17, at column 10, line 4, delete "10", and replace with --16--.

Signed and Sealed this

Nineteenth Day of September, 2000

*Attest:*

Q. TODD DICKINSON

*Attesting Officer*

*Director of Patents and Trademarks*